US006422792B1

(12) United States Patent
Carlson

(10) Patent No.: US 6,422,792 B1
(45) Date of Patent: Jul. 23, 2002

(54) METHOD AND APPARATUS FOR SUPPORTING A WALL BY UTILIZING A CHANNEL

(76) Inventor: Theodore J. Carlson, 84 Forest View Manor, Genoa, IL (US) 60135

( * ) Notice: Subject to any disclaimer, the term of this patent is extended or adjusted under 35 U.S.C. 154(b) by 0 days.

(21) Appl. No.: 09/587,680

(22) Filed: Jun. 5, 2000

(51) Int. Cl.[7] ..... E02D 5/00
(52) U.S. Cl. ..... 405/230; 405/272
(58) Field of Search ..... 405/230, 229, 405/231, 272; 52/121.1, 126.1, 126.4, 126.3

(56) References Cited

U.S. PATENT DOCUMENTS

| | | | | |
|---|---|---|---|---|
| 833,791 | A | * 10/1906 | Moran | |
| 3,796,055 | A | 3/1974 | Mahony | |
| 3,852,970 | A | 12/1974 | Cassidy | |
| 3,902,326 | A | 9/1975 | Langenbach, Jr. | |
| 4,070,867 | A | * 1/1978 | Cassidy | 61/53 |
| 4,634,319 | A | 1/1987 | May | |
| 4,673,315 | A | 6/1987 | Shaw et al. | |
| 4,678,373 | A | 7/1987 | Langenbach, Jr. | |
| 4,695,203 | A | 9/1987 | Gregory | |
| 4,708,528 | A | 11/1987 | Rippe | |
| 4,765,777 | A | 8/1988 | Gregory | |
| 4,854,782 | A | 8/1989 | May | |
| 4,911,580 | A | 3/1990 | Gregory et al. | |
| 4,925,345 | A | 5/1990 | McCown, Jr. et al. | |
| 4,997,314 | A | * 3/1991 | Hartman | 405/236 |
| 5,011,336 | A | 4/1991 | Hamilton et al. | |
| 5,013,190 | A | 5/1991 | Green | |
| 5,120,163 | A | 6/1992 | Holdeman et al. | |
| 5,123,209 | A | * 6/1992 | Nally | 52/165 |
| 5,139,368 | A | 8/1992 | Hamilton et al. | |
| 5,145,291 | A | 9/1992 | Bullivant | |
| 5,171,107 | A | 12/1992 | Hamilton et al. | |
| 5,213,448 | A | 5/1993 | Seider et al. | |
| 5,234,287 | A | 8/1993 | Rippe, Jr. | |
| 5,246,311 | A | * 9/1993 | West et al. | 405/230 |
| 5,722,798 | A | 3/1998 | Gregory | |
| 5,794,387 | A | * 8/1998 | Crookham | 52/122.1 |
| 5,800,094 | A | 9/1998 | Jones | |
| 5,970,665 | A | * 10/1999 | Oudman | 52/126.6 |

* cited by examiner

*Primary Examiner*—Thomas B. Will
*Assistant Examiner*—Raymond W. Addie
(74) *Attorney, Agent, or Firm*—Susan L. Lukasik

(57) ABSTRACT

An apparatus for and method of supporting a wall utilizes a multiple-featured support system. At least one support apparatus (200, 1000) is mounted to one or more walls (101), particularly foundation walls, in order to support the wall(s) and any load supported thereby, such as a building, statue, monument, bridge, and other structures. The support apparatus (200, 1000) may be mounted to the inside or outside of the wall. A channel (901) may be mounted between two adjacent support apparatus to provide a more structurally sound support system for different situations.

19 Claims, 6 Drawing Sheets

METHOD AND APPARATUS FOR SUPPORTING A WALL BY UTILIZING A CHANNEL

CROSS REFERENCE TO RELATED APPLICATIONS

Reference is made to U.S. patent application Ser. No. 09/587,636, titled "Method AND APPARATUS FOR SUPPORTING A WALL" and U.S. patent application Ser. No. 09/587,687, titled "METHOD AND APPARATUS FOR SUPPORTING MULTIPLE WALLS" both filed on the same day as the present invention on behalf of the same inventor of the present application, the disclosure of which prior application is hereby expressly incorporated by reference, verbatim, and with the same effect as though such disclosures were fully and completely set forth herein.

FIELD OF THE INVENTION

This invention relates to structural supports, including but not limited to method and apparatus for raising and supporting a wall and any structure supported thereby.

BACKGROUND OF THE INVENTION

Support walls or foundations that are constructed on inadequate soils, or support walls or foundations that impose excessive loads on the soil may, after time, settle into the ground. Occasionally, a building may settle in such a way that part of the building settles significantly lower than the rest of the building. In some instances, the entire building may settle significantly off level. Such settling may happen due to poor building materials, poor engineering of the building and/or preparation of the ground below the building, poor or changing soil conditions, and so forth.

Numerous systems for raising a building or a part thereof exist. Many of these systems utilize support devices, often called piles or piers, that attach to or otherwise support the foundation footing. The purpose of the footing is to distribute loads from the structure to the soil in such a manner that the building remains stationary. If the soil under the footing is not adequate to resist the load(s) of the building, or if the footing is too small to adequately distribute the building load(s) to the soil, then the footing has essentially failed. In addition, the footing typically extends out beyond the foundation wall on both sides so that piers that support the foundation at or under the footing are also carrying the weight of soil or other materials above the footing. Therefore, methods of stabilizing a foundation utilizing support devices, such as piles or piers, that attach to or otherwise support the foundation footing attach to an element of the foundation that no longer has any structural function and may cause the piering system to fail due to the additional loading of the soil and other materials above.

At times, a significant part of two or more walls of the foundation may require stabilization and perhaps raising as well. In these situations, support devices are utilized on each of the walls. When raising the foundation, one must be careful to raise contiguous walls at the same time to prevent stresses between the walls from cracking the walls of the foundation. Further, piers located away from the corner of the contiguous walls increase the probability of cracking the foundation walls at the corner.

Piers that are hydraulically driven into the ground use the weight of the building structure and the friction of the soil against the foundations as a reaction force to drive the pier. In some cases, the foundation wall may not have adequate strength to distribute the required load of the building structure to the pier.

Pier locations are somewhat dictated by the capacity of the foundation walls to span from pier to pier and support the weight of the structure. Deteriorated or cracked foundation walls may not have the capacity to carry the weight of the structure from pier to pier.

Accordingly, there is a need for a system for raising and supporting walls, and the structures supported thereby, that does not rely on the foundation footing, better supports structural corners without causing damage to the foundation, and supports walls having structural integrity problems.

DESCRIPTION OF A PREFERRED EMBODIMENT

Figure 1:
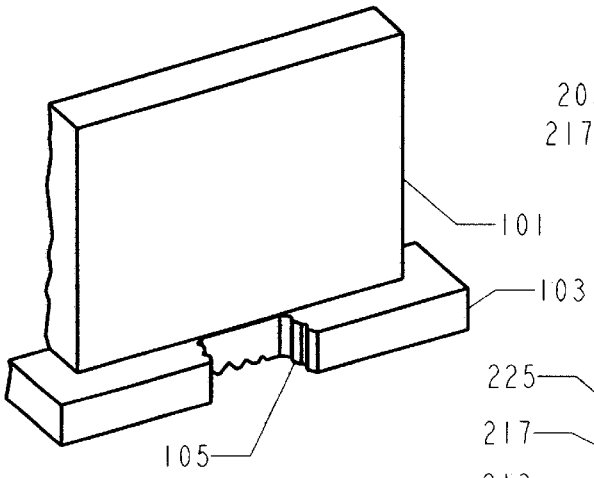
FIG. 1 is a diagram showing a foundation wall with a piece of footing broken away in accordance with the invention.
Figure 2B:
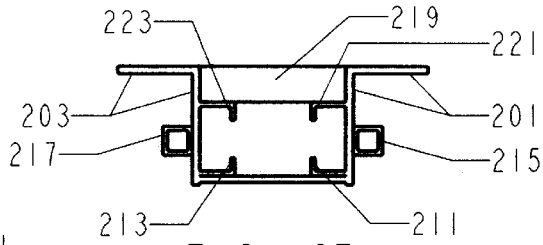
FIG. 2B is a diagram of a top aspect of a support assembly in accordance with the invention.
Figure 2A:
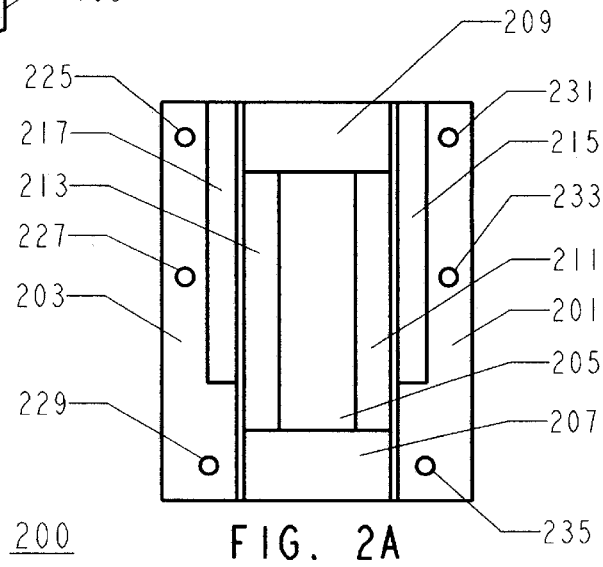
FIG. 2A is a diagram of a front aspect of a support assembly in accordance with the invention.
Figure 2C:
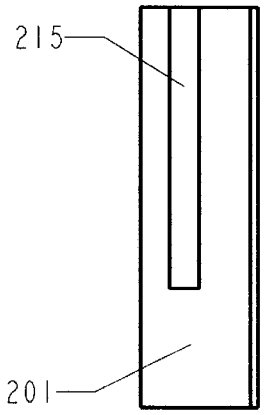
FIG. 2C is a diagram of a side aspect of a support assembly in accordance with the invention.
Figure 2D:
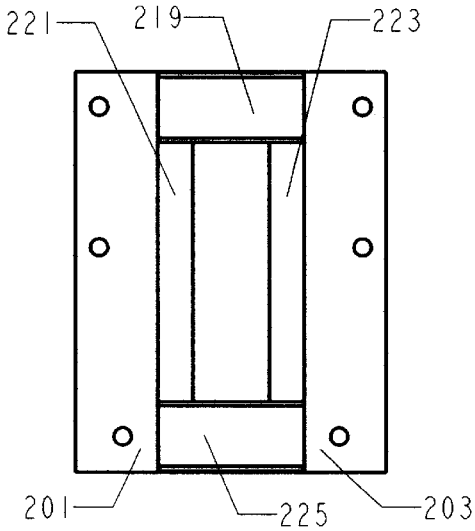
FIG. 2D is a diagram of a back aspect of a support assembly in accordance with the invention.

The following describes an apparatus for and method of supporting a wall utilizing a multiple-featured support system. One or more support apparatus are mounted to one or more walls, particularly foundation walls, in order to support the wall(s) and any load supported thereby, such as a building, statue, monument, bridge, and other structures. The support apparatus may be mounted to the inside or outside of the wall. One version of support apparatus is mounted to two different walls, so that both walls may be lifted simultaneously with even stress on both. A channel may be mounted between two adjacent support apparatus to provide a more structurally sound support system for different situations.

A support apparatus comprises a pile guide having at least a first side and a second side, a first support bracket operably coupled to the first side of the pile guide and mounted to a wall, and a second support bracket operably coupled to the second side of the pile guide and mounted to the wall. A first tube is operably coupled to the first side of the pile guide, a second tube is operably coupled to the second side of the pile guide, a first rod is partially disposed within the first tube and operably coupled to a load assembly, a second rod is partially disposed within the first tube and operably coupled to the load assembly, and a pile assembly is partially disposed within the pile guide and operably coupled to the load assembly, such that the wall is at least partially supported by the support apparatus. The first support bracket and the second support bracket are mounted to the wall without providing support to a footing attached to the wall.

At least one channel may be coupled to the pile guide, the first support bracket, and the second support bracket. The first support bracket and the second support bracket each comprise a first plane substantially at a right angle from a second plane, wherein the first plane of the first support bracket is attached to the first side of the pile guide, the first plane of the second support bracket is attached to the second side of the pile guide, and the second plane of the first support bracket and the second plane of the second support bracket are co-planar.

In the preferred embodiment, a method of producing a support assembly comprises the steps of welding two pieces of steel each having a lip to each of one or more channels, such that the lip from each piece extends away from the one or more channels, thereby forming a back-side guide panel and welding two pieces of steel each having a lip to each of one or more plates, such that the lip from each piece extends away from the one or more plates, thereby forming a front-side guide panel. A first support bracket and a second support bracket are formed, each comprising first plane at substantially a right angle from the second plane. The first plane of the first support bracket is welded to a first side of the back-side guide panel and a second side of the front-side guide panel. The first plane of the second support bracket is welded to a first side of the back-side guide panel and a second side of the front-side guide panel, such that the second plane of the first support bracket and the second plane of the second support bracket are co-planar. A first tube is welded to the first plane of the first support bracket and a second tube is welded to the first plane of the second support bracket. A rectangular shaft fits between the lips on the steel.

A diagram showing a foundation wall with a piece of footing broken away is shown in FIG. 1. Foundation walls 101 are typically build with a footing or continuous footing 103 to distribute the load of the foundation and structure above over a larger area of the supporting soil such that the bearing capacity of the soil is not exceeded. When the support apparatus is mounted to the outside of the wall 101, the ground near the area to be supported is dug away to expose enough of the foundation of the structure so that resultant hole is large enough for workers to work inside. In order to facilitate driving a pile, a piece of footing 105 is broken away below each location of a support apparatus. Alternatively, the support apparatus may be mounted to the inside of the wall 101, e.g., on the inside of a building or structure.

The location for each support apparatus is based on the load carrying capacity of the apparatus, the weight of the foundation and the load of the structure above the foundation, and the integrity, strength, size, and geometry of the foundation wall. The load of the structure being imposed on the foundation wall(s) is determined, based on the actual weight of the construction materials used and the required superimposed live load at each level as dictated by local building codes. A survey of the structure or a review of the building plans is used to determine the direction of the framing and location of any beams or headers. Once the weights, required live loading, and direction of the framing elements are determined, the load above each area of the foundation is added up by multiplying the weight and required live load by the contributory area to that area of the foundation. The weight of the foundation itself is then calculated based on its geometry and construction and that weight is added to the weight of the structure above. The section modulus, Sx, of the foundation wall is then calculated based on the formula $Sx=(b*h*h)/6$, where b represents the length of the base and height represents the length of the height. This section modulus multiplied by the tensile strength of the concrete and divided by a factor of safety gives the allowable bending moment for the foundation wall. The capacity of each support apparatus is dependent on numerous contributing factors, including size of the elements of the support apparatus, the composition of these elements, the construction of these elements, placement and size of welds, and the number and placement of bolts used to connect the apparatus to the wall (or other connection mechanism). The engineering analysis for combining each of these factors to provide the capacity of each support apparatus is known in the art. Using known engineering methods of analyzing a beam under load, the placement of each pile or apparatus is determined such that the capacity of the apparatus and the moment capacity of the foundation are not exceeded. In the preferred embodiment, any cracks in the foundation walls are considered as either a location for an apparatus or a location for a steel channel to bridge the wall from apparatus to apparatus.

A diagram of a support assembly 200 is shown in FIG. 2A through FIG. 2D. The support assembly is constructed prior to mounting it to the wall. In the preferred embodiment, the support assembly 200 is comprised of support brackets 201 and 203, which are each comprised of two planes, where one plane at substantially a right angle from the second plane, i.e., the support assembly is a piece of sheet steel with substantially a right angle bend in it. Alternatively, although the resultant support bracket is not as strong, the support bracket may be comprised of two plates or similar devices welded or otherwise connected at substantially a right angle.

Figure 3:
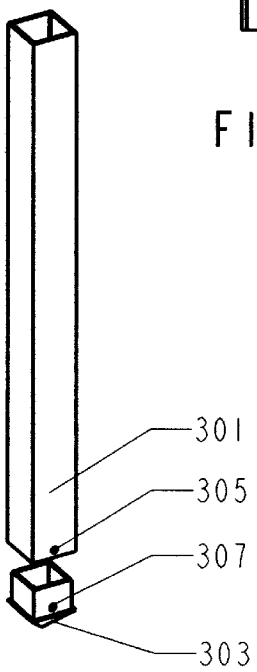
FIG. 3 is a diagram of a pile assembly in accordance with the invention.

In the preferred embodiment, a pile guide 205 is provided as follows. Between the support brackets 201 and 203, two channels 219 and 225 are welded, one at each end. Alternatively, a single channel (not shown) may be used in place of the two channels 219 and 225. Four guide sections 211, 213, 221, and 223, are each comprised of a piece of steel having a lip at substantially a right angle from the steel. The guide sections 211, 213, 221, and 223 are comprised of steel angles, bent plates, or two plates welded at the appropriate angle. Two of the guide sections 221 and 223 are mounted to the channels 219 and 225 and the support brackets 201 and 203, such that the lips extend away from the channels 219 and 225. The other two guide sections 211 and 213 are mounted to front plates 207 and 209 and the support brackets 201 and 203 such that the lips extend away from the front plates 207 and 209. Alternatively, a single plate (not shown) may be used in place of the two front plates 207 and 209. The lips of the opposing guide sections, 211 and 221 and 213 and 223, face each other such that a pile assembly, such as shown in FIG. 3, slides between each of the lips. Two tubes 215 and 217 are mounted to one of the planes of the support brackets 201 and 203, as shown in FIG. 2. In the preferred embodiment, each of the pieces of the support assembly is welded together, as is known in the art. The size of each component that makes up the support assembly and the pile may be varied depending on the loading conditions and the soil conditions.

The support brackets 201 and 203 are mounted to the wall 101. In the preferred embodiment, the top holes 225 and 231 of each support bracket 201 and 203 are mounted with expansion anchors, and the remaining holes are mounted with epoxy bolts. Higher capacity brackets require more holes and bolts for mounting. How to use expansion anchors and epoxy bolts is known in the art. The support apparatus 200 is thus mounted to the wall 101 without needing to provide support to the footing 103 attached to the wall 101.

Figure 4:
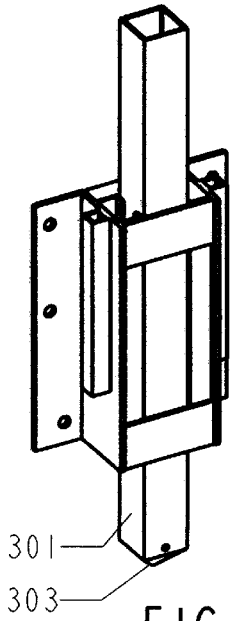
FIG. 4 is a diagram showing a pile assembly installed in a support assembly in accordance with the invention.

A pile assembly is comprised of a pile shaft 301 and pile head or pile point 303, as shown in FIG. 3, in the preferred embodiment. The pile shaft 301 has a hole 305 and the pile head has a hole 307 such that when the pile head 303 is inserted in the pile shaft 301, the holes 305 and 307 line up, and a bolt may be inserted through the holes and capped with a nut to hold the assembly together. The size of the pile shaft 301 may be smaller or larger depending on the loading and soil conditions. In the preferred embodiment, the pile shaft 301 is rectangular, preferably square, in shape. Other shapes of pile shafts will be successful, most proficiently operating when the pile guide 205 is adapted to the shape of the pile shaft 301. The pile assembly 300 is inserted into the pile guide 205 as shown in FIG. 4. In the preferred embodiment, the pile assemblies and pile guide are galvanized.

Figure 5:
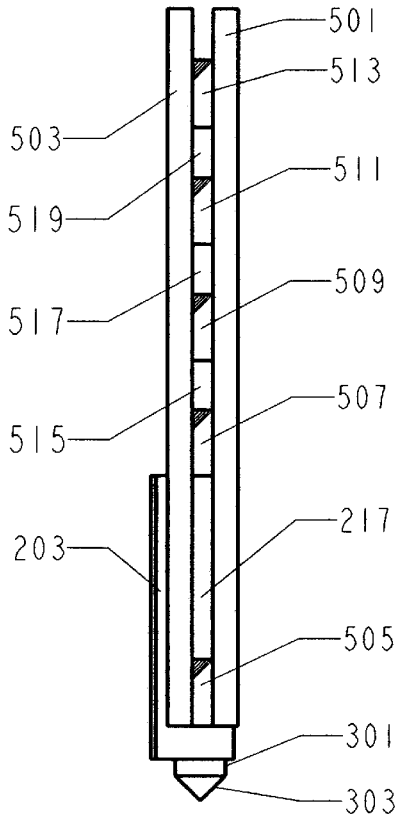
FIG. 5 is a diagram showing a ladder assembly coupled to a support assembly in accordance with the invention.

Two ladder assemblies comprised of tube steel and steel plates or bars are coupled to the support assembly as shown in FIG. 5. In the preferred embodiment, each ladder assembly is comprised of two long plates or bars 501 and 503 and several short reaction tube steels 505, 507, 509, 511, and 513 between them, which are all welded together with spaces 515, 517, 519 between the short support channels 505, 507, 509, 511, and 513 as shown in FIG. 5. The lowest short support channels 505 and 507 fit closely around the tube 217 of the support bracket 203. The number of short support channels depends on how long the ladders are, which length should be sufficient to assist in driving the pile assembly into the ground. In the preferred embodiment, the ladders are six feet long, although ladders of other lengths will also provide a successful implementation. When driving piles in the inside of a building, shorter ladders are preferably used.

Figure 6:
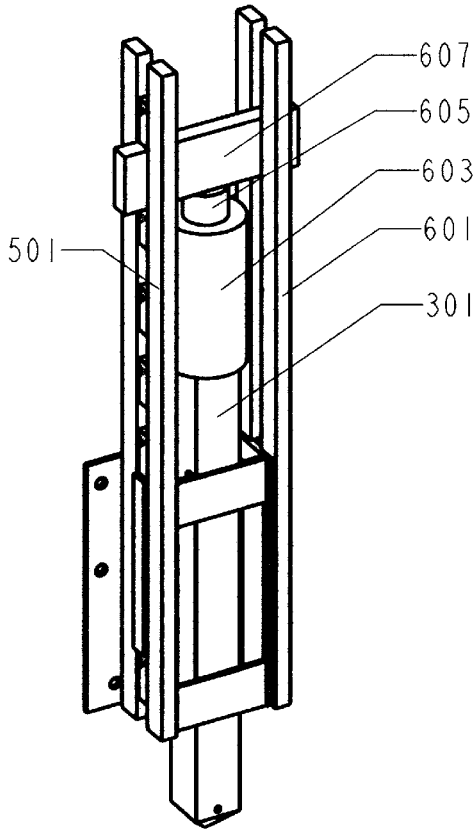
FIG. 6 is a diagram showing two ladder assemblies coupled to a support assembly and a hydraulic jack in accordance with the invention.

FIG. 6 shows two ladder assemblies 501 and 601 coupled to a support assembly 200. A hydraulic jack 603 is placed on top of the pile shaft 301 with the jack's piston 605 on top. A reaction plate 607, which is comprised of solid steel in the preferred embodiment, is inserted in one of the spaces 515 in the ladders above the jack 603. The jack 603 is pressurized until its piston 605 presses against the reaction plate 607.

Figure 7:
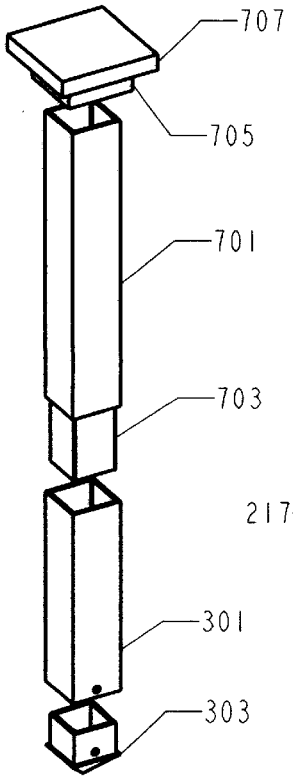
FIG. 7 is an extended pile assembly with a pile cap assembly in accordance with the invention.

The jack 603 is then pressurized, thereby driving the pile assembly into the ground. The piston 605 is periodically dropped so that the reaction plate 607 may be placed in a lower space 517 in the ladders. The pile assembly 300 is driven down until either the length of the shaft runs out or the desired resistance is reached, i.e., the calculated load of the wall on the pile plus a safety factor as may be read on the hydraulic jack 603. The resistance is calculated by multiplying the pressure in the hydraulic system by the area of the hydraulic piston. If the shaft runs out of length another shaft 701 with a tab 703 is inserted into the pile shaft 301 as shown in FIG. 7, and the process is continued (pressurizing the jack 603, and if necessary, adding more lengths of shaft 701) until the desired resistance on the pile assembly 300 is reached. In the preferred embodiment, when the desired resistance is reached, a pile cap, comprising a plate 707 and tube steel 705 welded together to slide over the topmost end of the pile assembly 300, is placed at the top of the pile assembly to distribute the load across the entire cross-sectional area of the pile shaft 301 and/or 701. Addition of the pile cap is optional.

Figure 8A:
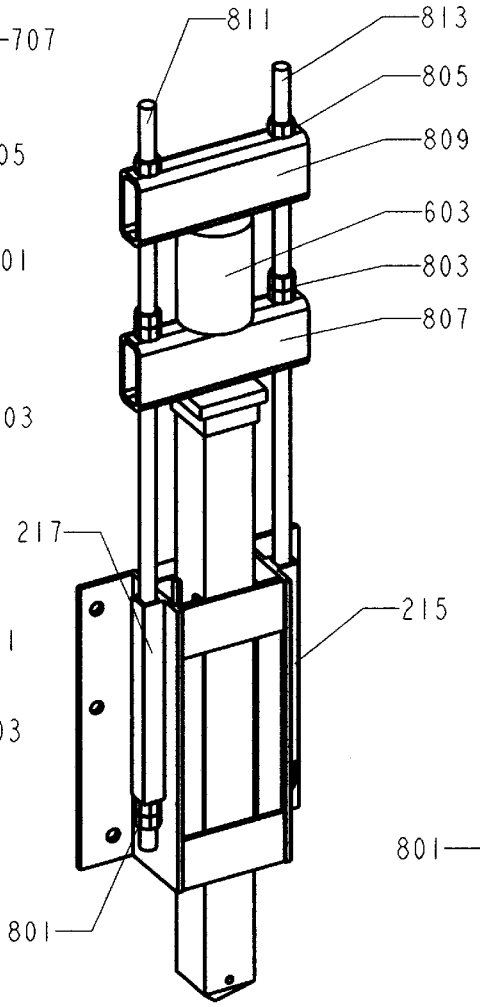
FIGS. 8A, 8B, 8C, and 8D show various stages of a wall being raised by a support apparatus in accordance with the invention.

As shown in FIG. 8A, a rod 811 is placed through one of the tubes 217 and fastened. A second rod 813 is placed through the other tube 215 and fastened. In the preferred embodiment, the rods are comprised of threaded carbon steel and fastened with bolts 801 below the tubes 215 and 217 near the lower end of the rods 811 and 813. The rods 811 are then coupled to a load assembly. In the preferred embodiment, the load assembly is comprised of a first load transfer block 807, a second load transfer block 809, and a series of bolts 803 and 805 fastened to the rods 811 and 813. The first load transfer block 807 has two holes in which the rods 811 and 813 are inserted. In the preferred embodiment, the load transfer blocks are comprised of hollow tube steel. The load transfer blocks may alternatively be comprised of steel bars with drilled holes, back-to-back channels, steel angles, or other devices known in the art to provide the function described. A set of nuts 803 is fastened to each of the rods 811 and 813, just above the first load transfer block 807. A hydraulic jack 603, such as the one shown in FIG. 6, is placed on top of the first load transfer block 809, with the piston 605 on top. The second load transfer block 809, which is similar to the first load transfer block 807, also has holes in which the rods 811 and 813 are inserted. The second load transfer block 809 rests on the hydraulic jack 603. Another set of nuts 805 is fastened to each rod just above the second load transfer block 809.

Figure 8B:
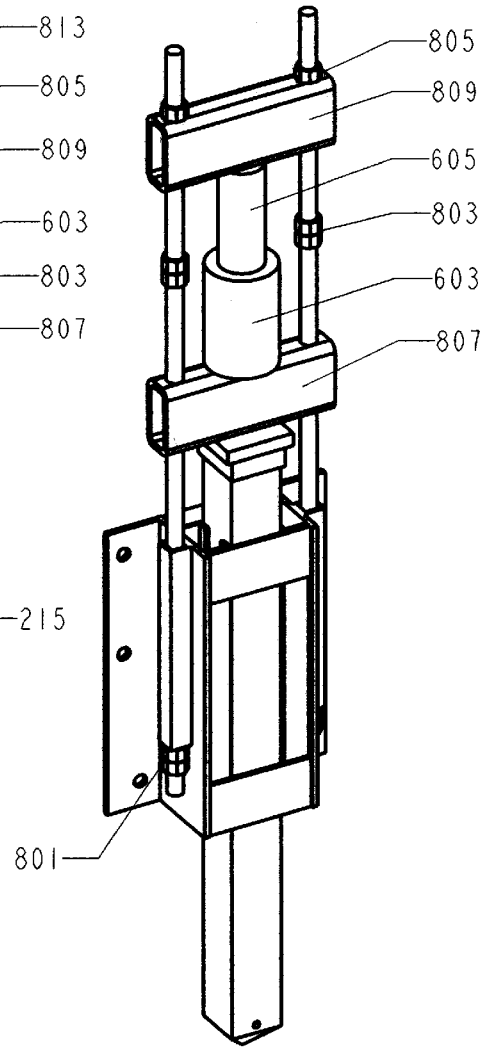
Figure 8C:
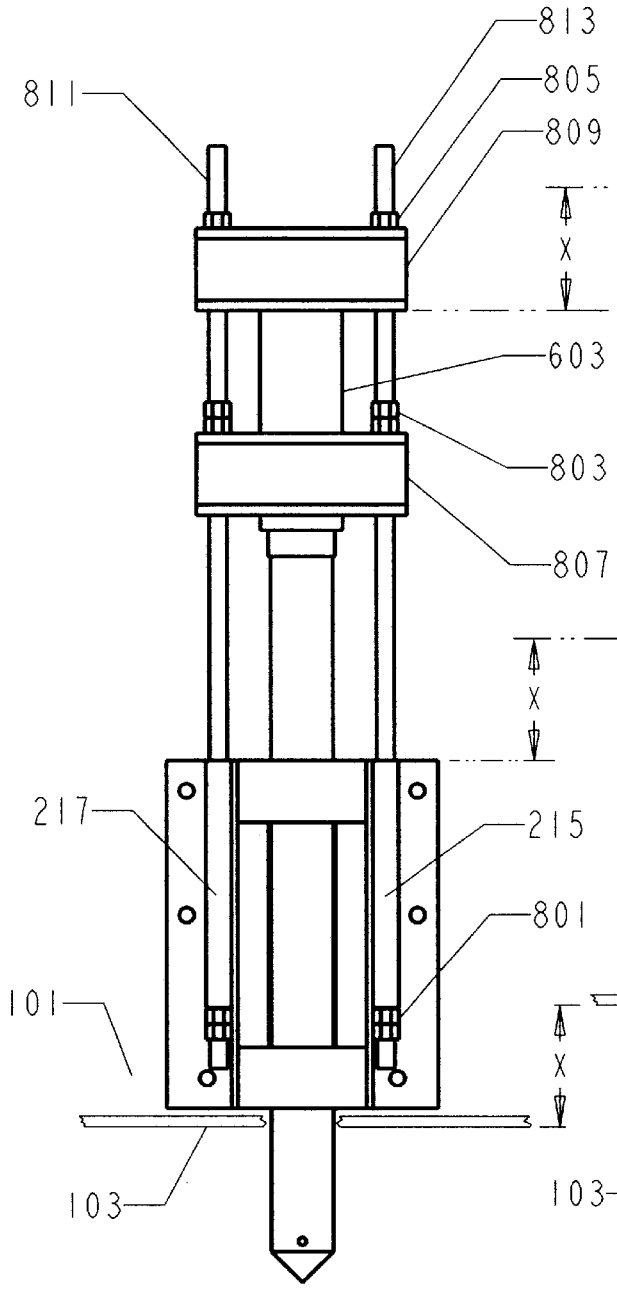
Figure 8D:
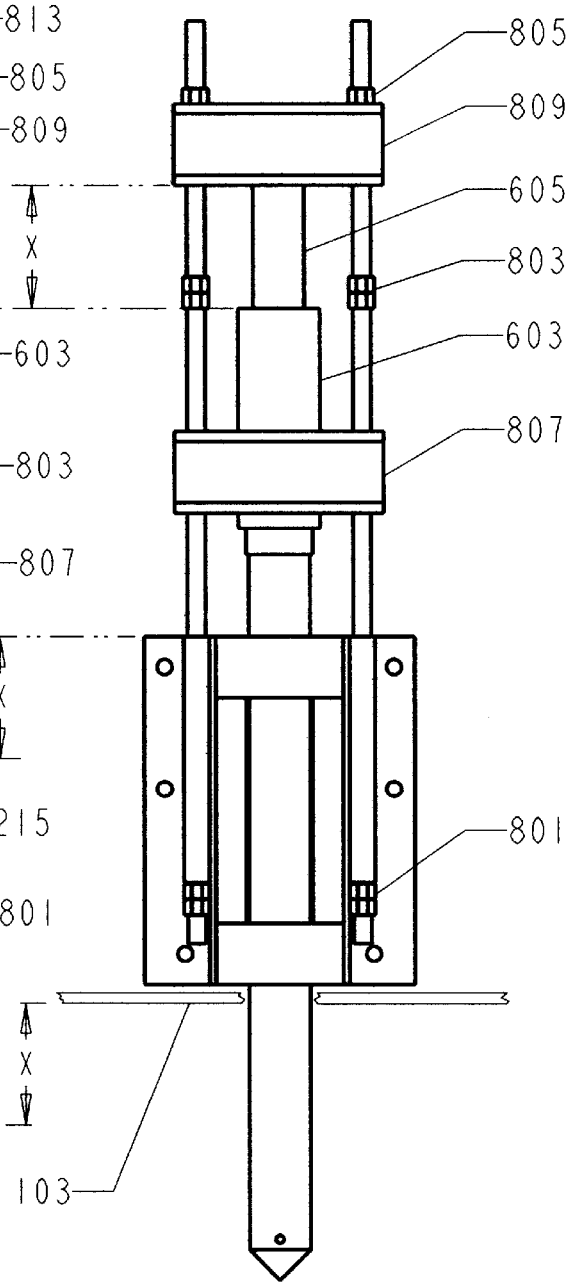

As shown in FIG. 8B, pressure is applied to the hydraulic jack 603, such that the distance X the piston 605 rises is the distance the wall 101, and anything coupled thereto, is lifted. The pile assembly 300, first load transfer block 807, and hydraulic jack 603 (except for the piston 605) do not move as pressure exerted on the second load transfer block 809 by the piston 605 moves the rods 811 and 813 and support apparatus 200, and thereby the wall 101, which is mounted to the support apparatus. The wall 101 is thus lifted by the distance X.

If the wall 101 needs to be lifted by more than the maximum height of the piston 605, after the wall is lifted by the maximum height of the piston 605, the second set of nuts 803 is lowered to the top of the first load transfer block 807. The piston 605 is then lowered, and the second load transfer block 809 follows along. The last set of nuts 805 is then tightened to just above the second load transfer block 809. The process is repeated until the wall 101 is lifted the desired distance above its previous location. When the wall 101 is lifted to its desired location, the nuts 803 are tightened against the first load transfer block, and optionally, the rods 811 and 813 are cut just above the nuts 803, thereby removing the second load transfer block 809, in the preferred embodiment. When this process is completed, the excavated hole next to the foundation wall may then be filled in.

In the event that multiple support devices 200 are utilized on a single wall or building, care should be taken to be sure that each support device 200 is lifted at approximately the same time, or at very small amounts one at a time, such that the lifting of the wall or structure at one device 200 does not put too much strain or stress on the wall or structure, which could damage the wall or structure. When multiple support devices 200 are used, one may need to be raised more than the others, thus care should be taken to pressurize the various support devices such that the wall 101 or structure is generally lifted as a whole and to a level position.

Figure 9A:
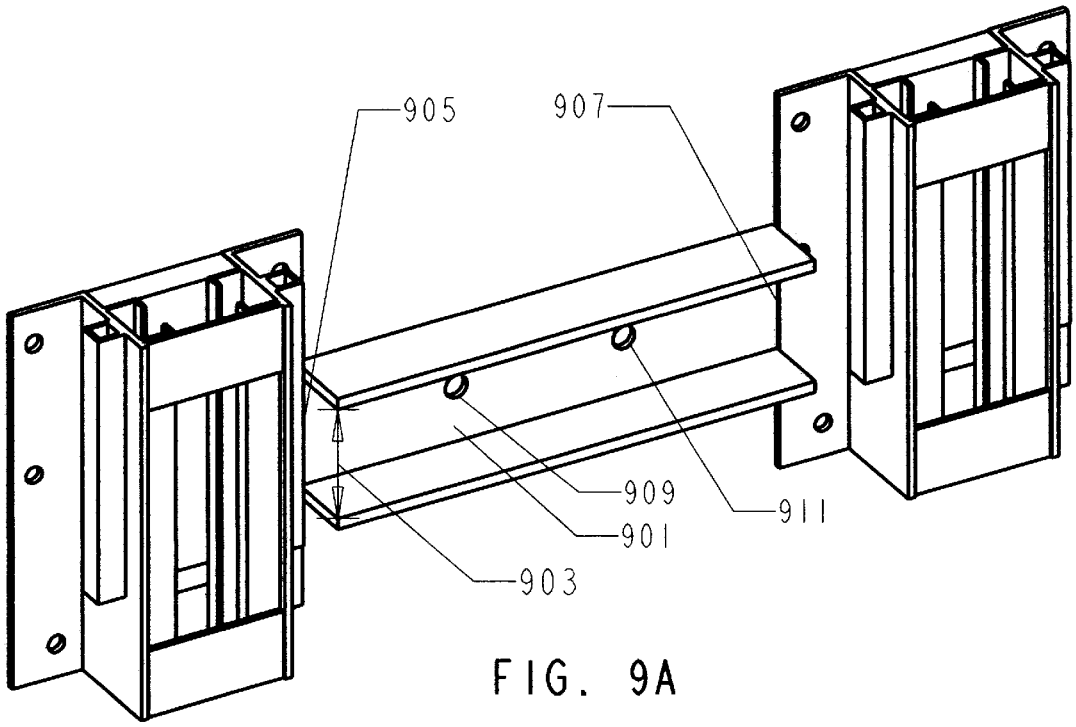
FIG. 9A is a diagram showing the use of a channel between two support assemblies in accordance with the invention.
Figure 9B:
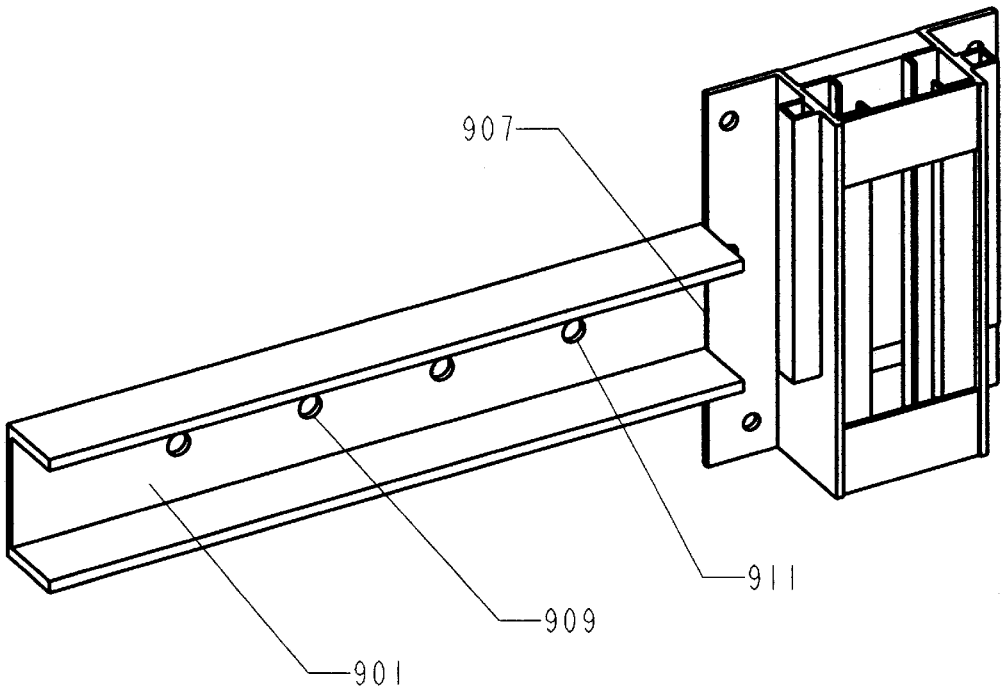
FIG. 9B is a diagram showing the use of a channel between a support assembly and a stable wall in accordance with the invention.

An enhancement to the support device 200 described above, the support device described in FIG. 10A and FIG. 10B, and/or other support devices and systems as are known in the art comprises adding a channel 901 between two support devices 200 mounted to a wall, as shown in FIG. 9A, or adding a channel 901 to a support device and a stable wall, as shown in FIG. 9B. The channel 901 is operably coupled to the two support devices 200. In the preferred embodiment, the channel 901 is a c-channel comprised of carbon steel. The channel depth 903 may be varied to support more weight. The amount of weight supported by the channel is calculated using known engineering techniques, based on the required load carrying capacity, as described above. In the preferred embodiment, welding is provided to mount the channel 901 to the first support apparatus 905 and to mount the channel 901 to the second apparatus 907. Alternatively, the channel may be mounted to each of the support apparatus by bolting it to the support apparatus. In the preferred embodiment, the channel is mounted to the wall to adequately transfer the calculated weight of the walls and structure and other load supported thereby to the channel. In the preferred embodiment, the channel 901 is bolted to the wall 101 with expansion anchors or epoxy bolts through holes 909 and 911 in the channel 901.

As shown in FIG. 9B, a channel 901 is mounted to a single support assembly as well as to a stable part of the wall. This configuration is useful for providing additional support when a stable part of the wall is in close proximity to the area requiring stabilization and/or raising. The channel 901 may be mounted to the wall before or after the wall is raised, although only a single bolt should be used to mount the channel 901 prior to raising to allow the wall to be raised without causing additional friction.

By adding the channel as described above, the two support devices 200, as coupled to the channel 901, may be spaced further apart than if the support devices were connected exclusively to the wall without the channel 901. Use of the channel 901 eliminates the need for the wall 101 to have the integrity, section modulus, or strength to span from support device to support device. Therefore, use of channel 901 may reduce the number of support devices required to stabilize and/or lift walls and the structure supported by the walls, which load could not otherwise be stabilized or lifted due to the poor condition of the walls. The use of a channel 901 between support devices/assemblies would be successful with support devices that are mounted solely to a wall, such as the support devices described in FIG. 2 or FIG. 10 herein, or other support assemblies that at least partially support the footing 103 of the wall 101.

A method of utilizing a channel in a support system comprises the steps of mounting at least a first support assembly at least to the wall 101, optionally mounting a second support assembly at least to the wall 101, and mounting the channel 901 to the first support assembly and either the second support assembly or the wall 101, as appropriate. The at least one support assembly may be utilized to lift at least a part of the wall 101. The channel may be mounted to the wall before or after lifting at least part of the wall 101. In the preferred embodiment, the wall 101 or structure is lifted after the channel 901 is mounted to the support devices. This method is particularly useful for restoring the integrity of walls that are cracked or damaged. Further, with the use of a channel 901 as described above, fewer support devices may be needed because the system comprising a channel mounted to support devices and the wall supports the weight of the wall and its load over a longer span than the wall alone can. Channels work well to support deteriorated walls, walls with cracks, walls that lack the structural capacity to span from pile to pile, e.g., where inadequate section properties or tensile or compressive strength are lacking.

Figures 10A, 10B:
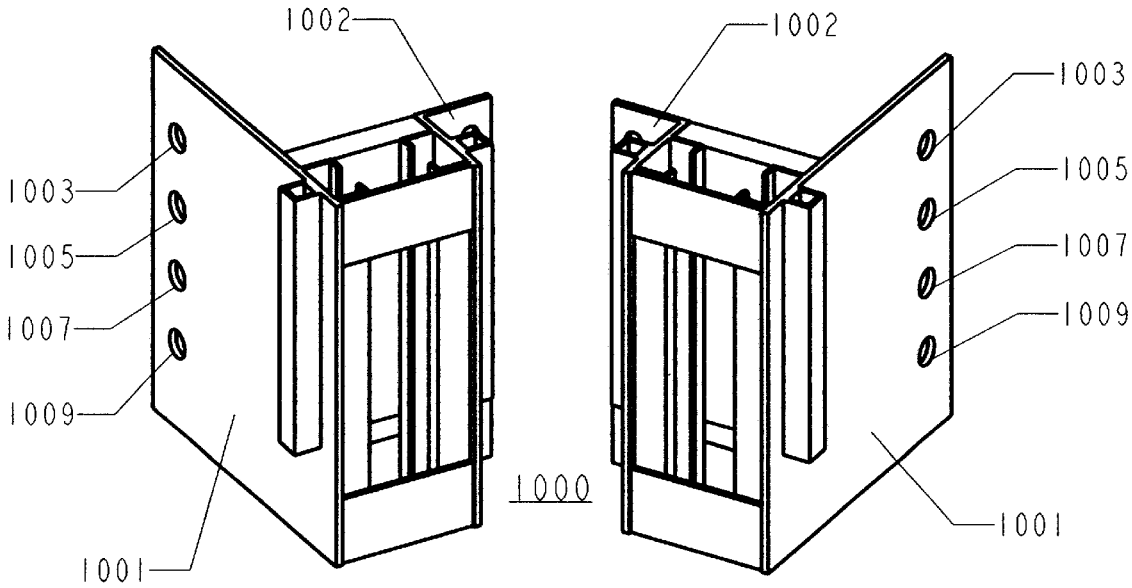
FIGS. 10A and 10B are two different corner support assemblies in accordance with the invention.

An additional useful feature of the support system is a support apparatus that is able to support a load from two different walls simultaneously. Two different versions of such a support apparatus, which shall be referred to as a corner support 1000, are shown in FIG. 10A and 10B. These corner supports are particularly useful for supporting loads at the corner of a building. Although the assemblies shown in FIG. 10 are useful for walls that meet at a right angle, the corner support may be altered to fit adjoining walls at any angle by matching the angle of the support brackets to the angle of the adjoining walls.

A support apparatus, useful for supporting two walls, comprises a pile guide having at least a first side and a second side, a first support bracket operably coupled to the first side of the pile guide and mounted to a first wall, and a second support bracket operably coupled to the second side of the pile guide and mounted to a second wall that is not the first wall. A pile assembly is partially disposed within the pile guide and operably coupled to a load assembly, such that the first wall and the second wall are at least partially supported by the support apparatus. Optionally, a first tube is operably coupled to the first side of the pile guide, a second tube is operably coupled to the second side of the pile guide, a first rod is partially disposed within the first tube and operably coupled to the load assembly, a second rod is partially disposed within the first tube and operably coupled to the load assembly.

The first support bracket is mounted to the first wall and the second support bracket is mounted to the second wall without providing support to a footing attached to either wall. The support apparatus may further comprise at least one channel coupled to the pile guide, the first support bracket, and the second support bracket. The pile assembly may be comprised of a rectangular pile shaft operably coupled to a pile head. The load assembly may be comprised of at least one load transfer block comprising at least two holes, through which the first rod and the second rod are assembled. The first rod and the second rod may be threaded. A pile cap may be operably coupled to the pile assembly.

In the preferred embodiment, a method of producing a support assembly comprises the steps of welding two pieces of steel, such as the guide sections 211, 213, 221, and 223 as described with respect to FIG.2, each having a lip to each of one or more channels, such that the lip from each piece extends away from the one or more channels, thereby forming a back-side guide panel, welding two pieces of steel each having a lip to each of one or more plates, such that the lip from each piece extends away from the one or more plates, thereby forming a front-side guide panel, forming a first support bracket comprising first plane and a second plane, wherein the first plane is at substantially a right angle from the second plane, and welding the first plane of the first support bracket to a first side of the back-side guide panel and a second side of the front-side guide panel. A second support bracket that is substantially planar to a first side of the back-side guide panel and a second side of the front-side guide panel, is welded such that the second plane of the first support bracket and the plane of the second support bracket are at substantially a right angle, and a first tube is welded to the first plane of the first support bracket and a second tube is welded to the second support bracket, such that a rectangular shaft fits between the lips on the steel.

The corner supports 1000 shown in FIG. 10A and FIG. 10B are built the same as the support assembly 200 of FIG. 2, except that one of the support brackets 1001 in the corner bracket meets at substantially a right angle to the other support bracket 1002. In FIG. 2, the support brackets each have two planes, one plane of each support bracket being co-planar, and the other planes are parallel. The corner brackets 1000 instead have one bracket 1001 that has a single plane, and a second bracket 1002 similar to those in FIG. 2. This single-plane bracket 10001 is parallel to one plane of the second bracket 1002 and at a right angle to the other plane of the second bracket 1002. One may advantageously choose which corner bracket 1000 is used, that of FIG. 10A or FIG. 10B, based on considerations of placement of the pile guide. For example, one wall may have poorer soil quality or longer pile shafts may be needed to support the wall, or a physical structure, such as a gas pipe, meter, or electrical conduit, may prevent the pile guide from residing on one wall or the other. In the preferred embodiment, the single plane bracket 1001 is mounted to one wall with expansion bolts in all of the holes 1003, 1005, 1007, and 1009. Larger systems that need to support more weight, e.g., more than 20 tons, require more holes and thus more bolts, as well as larger supports. The remainder of the corner support 1000 is mounted to the other wall in the manner described with respect to FIG. 2 above. The corner support 1000 is used to lift both walls simultaneously by following the same steps described above for the support assembly of FIG. 2. When a corner support 1000 is utilized, both walls are supported with equal stress, thereby preventing any sheering stress that may result from utilizing a support device individually on both walls. The corner support 1000 provides equal support around the corner better than having a support device on the face of each wall.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A support system comprising:

a first support assembly mounted to a first wall such that the first support assembly supports a first part of the first wall;

a channel, operably coupled to the first support assembly, wherein the channel is arranged and constructed to support a second part of the first wall, and wherein the first part of the first wall and the second part of the first wall are adjacent;

wherein the channel is operably coupled to and between the first support assembly and a second support assembly such that at least one of: the support assemblies are located further apart while still supporting the first wall and an area of weakened foundation is bridged over by the channel.

2. The support system of claim 1, wherein the first support assembly is mounted solely to the first wall.

3. The support system of claim 1, wherein the first support assembly at least partially supports a footing of the first well.

4. The support system of claim 1, wherein the channel size is increased to support a part of the first wall in addition to the second part.

5. The support system of claim 1, wherein the first support assembly comprises:

a pile guide having a cavity and at least a first side and a second side;

a first support bracket operably coupled to the first side of the pile guide and mounted to the first wall;

a second support bracket operably coupled to the second side of the pile guide and mounted to the first wall;

a first tube operably coupled to the first side of the pile guide;

a second tube operably coupled to the second side of the pile guide;

a pile assembly partially disposed within the cavity of the pile guide and operably coupled to a load assembly, such that at least a part of the first wall is supported by the support system, and wherein the pile assembly is in a sliding relationship with the pile guide.

6. The support system of claim 1, wherein the first support assembly comprises:

a pile guide having a cavity and at least a first side and a second side;

a first support bracket operably coupled to the first side of the pile guide and mounted to the first wall;

a second support bracket operably coupled to the second side of the pile guide and mounted to a second wall that is not the first wall;

a first tube operably coupled to the first side of the pile guide;

a second tube operably coupled to the second side of the pile guide;

a pile assembly partially disposed within the cavity of the pile guide and operably coupled to a load assembly, such that the first wall and the second wall are at least partially supported by the support system, and wherein the pile assembly is in a sliding relationship with the pile guide.

7. The support system of claim 1, wherein the channel is welded to the at least one support assembly.

8. The support system of claim 1, wherein the channel is bolted to the at least one support assembly.

9. The support system of claim 1, wherein the channel is mounted to the first wall.

10. The support system of claim 1, wherein the channel extends along the first wall and away from the first support assembly and toward the second part of the first wall.

11. The support system of claim 1, further comprising a second support assembly mounted to the first wall such that the second support assembly supports a third part of the first wall and wherein the channel is operably coupled to the second support assembly and disposed between the first support assembly and the second support assembly.

12. A method comprising the steps of:

mounting at least one support assembly to a first wall such that the at least one support assembly supports at least a first part of the first tall, but does not support a second part of the first wall;

mounting a channel to the at least one support assembly such that the second part of the first wall is supported by the combination of the at least one support assembly and the channel, wherein the first part of the first wall and the second part of the first wall are adjacent at least partially in a horizontal direction, wherein the channel extends at least partially horizontally along the first wall and away from the first support assembly and at least toward the second part of the first wall.

13. The method of claim 12, further comprising the step of lifting at least a part of the first wall utilizing at least one of the support assemblies.

14. The method of claim 12, wherein the step of mounting the channel comprises the step of welding the channel to the at least one support assembly.

15. The method of claim 13, wherein the step of mounting the channel takes place after the step of lifting.

16. The method of claim 13, wherein the step of mounting the channel takes place before the step of lifting.

17. The method of claim 12, further comprising the step of mounting the channel to the first wall.

18. The method of claim 12, further comprising the step of mounting the channel to a stable part of the first wall and one support assembly.

19. The method of claim 12, wherein the at least one support assembly comprises a first support assembly and a second support assembly, the method further comprising the step of operably coupling the first support assembly, the second support assembly, and the channel, such that at least one of: the support assemblies are located further apart while still supporting the first wall and an area of weakened foundation is bridged over by the channel.

* * * * *

UNITED STATES PATENT AND TRADEMARK OFFICE

CERTIFICATE OF CORRECTION

PATENT NO. : 6,422,792 B1
DATED : July 23, 2002
INVENTOR(S) : Theodore J. Carlson It is certified that error appears in the above-identified patent and that said Letters Patent is hereby corrected as shown below:

Column 9,
Line 67, replace "well" with -- wall --.

Column 10,
Line 58, replace "tall" with -- wall --.

Signed and Sealed this

Seventeenth Day of September, 2002

*Attest:*

*Attesting Officer*

JAMES E. ROGAN
*Director of the United States Patent and Trademark Office*